United States Patent [19]

Solinski

[11] Patent Number: 4,461,056

[45] Date of Patent: Jul. 24, 1984

[54] SHOWER AND DECORATIVE CURTAIN SUSPENSION FOR A BATHROOM STALL

[76] Inventor: Walter Solinski, 365 Smith Ct., Fairbanks, Ak. 99701

[21] Appl. No.: 337,965

[22] Filed: Jan. 8, 1982

[51] Int. Cl.[3] ..... A47H 1/022

[52] U.S. Cl. ..... 16/87.4 R; 4/610; 16/95 D; 160/123; 248/264; 410/123

[58] Field of Search ..... 16/87.4 R, 94 R, 94 D, 16/95 R, 95 D, 95 W, 95 DW, 96 R, 96 D, 96 L; 160/123, 124, 330, DIG. 9; 4/607, 608, 610; 248/264; 410/122, 123, 143, 151

[56] References Cited

U.S. PATENT DOCUMENTS

| | | | |
|---|---|---|---|
| 183,095 | 10/1876 | Winger | 160/124 X |
| 562,601 | 6/1896 | Gernaud | 160/330 X |
| 763,844 | 6/1904 | Benson | 248/264 X |
| 891,897 | 6/1908 | Astrom | 410/151 X |
| 1,598,479 | 8/1926 | Day et al. | 16/87.4 R |
| 1,601,372 | 9/1926 | Ranson | 16/94 D |
| 1,679,881 | 8/1928 | Simpson | 160/330 |
| 1,951,660 | 3/1934 | Klaudt | 16/94 D |
| 2,964,276 | 12/1960 | Silverthorne | 248/264 X |
| 4,361,915 | 12/1982 | Siewart | 4/610 X |
| 4,381,578 | 5/1983 | Glejf | 16/94 D |

*Primary Examiner*—Fred Silverberg

[57] ABSTRACT

A pair of horizontally extending curtain rods for bathroom stalls comprising a mechanism whereby the rods are each supported by end brackets which are adapted to be force-fitted against the walls of the stall to retain the pair of rods in tight engagement with the side walls of the stall. One of the pair of rods is employed primarily to support a conventional shower curtain suspended therefrom whereas the other of the rods supports a decorative curtain extending from the rod to a position closely adjacent the floor of the stall.

5 Claims, 5 Drawing Figures

SHOWER AND DECORATIVE CURTAIN SUSPENSION FOR A BATHROOM STALL

BACKGROUND OF THE INVENTION

Bathroom stalls usually combine a tub or basis along with the customary water inlets and drain area. Or in some instances, the bathroom stall merely comprises an opening formed in a bathroom, minus the customary tub or basin. In both types of bathroom stalls, there is usually provided an horizontal extending rod from which is hung a curtain so as to prevent the splashing of water from within the stall area to the surrounding area.

With the above in mind, it is one object of the invention to provide a pair of horizontally extending rods from which are suspended a first curtain usually formed of a water repellant cloth or plastic, and a second decorative curtain suspended from a second rod to thus enhance the appearance of the shower stall.

Another object of the invention is to provide a pair of brackets which are used for supporting both the conventional shower curtain and a second decorative curtain which is adapted to overlie the customary shower curtain.

Another object of the invention is to provide a pair of externally threaded bolt members extending from the sides of the shower curtain hanger which are adjustably secured to a pair of wall engaging brackets to thus retain the shower curtain rod in proper position between the side walls of the shower stall.

Another object of the invention is to provide a means whereby a decorative curtain may be suspended from a rod which is supported by the shower curtain rod.

Another object of the invention is to provide a means whereby the decorative curtain hanger rod may be adjustably mounted to the shower curtain rod and when adjusted with respect thereto, the same may be locked in position.

Other objects will appear as the description proceeds when taken in connection with the accompanying drawings.

DESCRIPTION OF THE PREFERRED EMBODIMENTS

Figure 5:
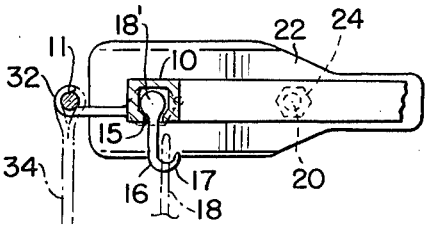
FIG. 5 is a section taken on lines 5—5 of FIG. 4, looking in the direction of the arrows.

Referring now to the drawings wherein like reference numerals are employed to designate like parts throughout the several views, 10 designates a shower curtain hanger rod and 11 designates a decorative curtain hanger rod. Rods 10 and 11 are formed of any suitable material such as metal, plastic or the like. As shown more particularly in FIG. 5 of the drawings, the shower curtain hanger rod is of square formation whereas the decorative curtain hanger rod 11 is of circular formation. The shower curtain rod 10 extends substantially the width of the shower stall 12 and is provided with curved end portions 13 and 14 and is provided with a slot 15 extending throughout the length of the rod 10. Mounted for sliding engagement with the rod 10 and extending into slot 15 are a plurality of shower curtain hangers 16. One end of the hangers 16 terminates in a hook portion 17 wherein a ball member 18' is provided at the opposite end of the hanger and as shown more clearly in FIG. 5 of the drawings, the ball is adapted to be held for travel in the slot 15.

A conventional shower curtain 18 made of any suitable material such as a waterproof fabric or plastic, is provided with a plurality of eyelets 19 which are engaged by the hooks 17 to thereby suspend the curtain from the rod 10. Formed integral with or otherwise secured to each end portion of hanger rod 10 are a pair of externally threaded bolt members 20, 21, which extend outwardly in the general axial direction of said rod 10. Each pair of the bolt members extend with a sliding fit into apertures disposed in one of a pair of opposed and aligned block members 22, 22 which are adapted to engage with the opposed walls of a shower stall entrance.

The blocks 22 may be constructed of any suitable material such as metal, plastic, wood or the like and the wall engaging face 23 may be provided with a rubber facing so as to increase the holding power of the blocks when the rods 10 and 11 are installed in the shower stall 12 in the manner to be described hereinafter.

To install the hanger rods within the shower stall 12,each of the externally threaded bolt members 20, 21 are provided with internally threaded nuts 24, 25, which are threaded over bolt members 20, 21. As can be appreciated, when the nuts 24 are rotated on the bolts 20, 21, the same will force the blocks outwardly and into engagement with the side walls 26, 27 of the stall 12. Thus, the shower curtain hanger rod 10 may be brought into tight engagement with the walls 26, 27 of the stall 12 and a shower curtain suspended therefrom without having to provide openings in the side walls of the stall to accommodate a fastener means for securing the hanger rod 10 in proper position within the stall opening 12.

Figure 1:
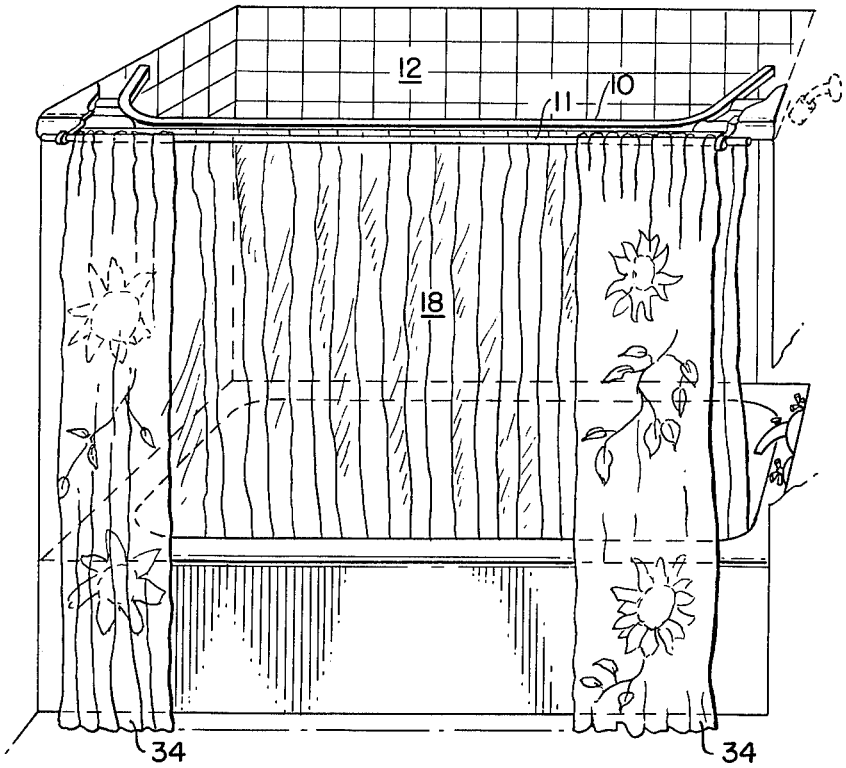
FIG. 1 is a perspective view showing the arrangement of the shower and decorative curtains of the present invention.
Figure 3:
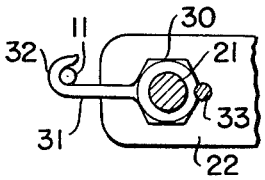
FIG. 3 is a section taken on lines 3—3 of FIG. 2 looking in the direction of the arrows.
Figure 2:
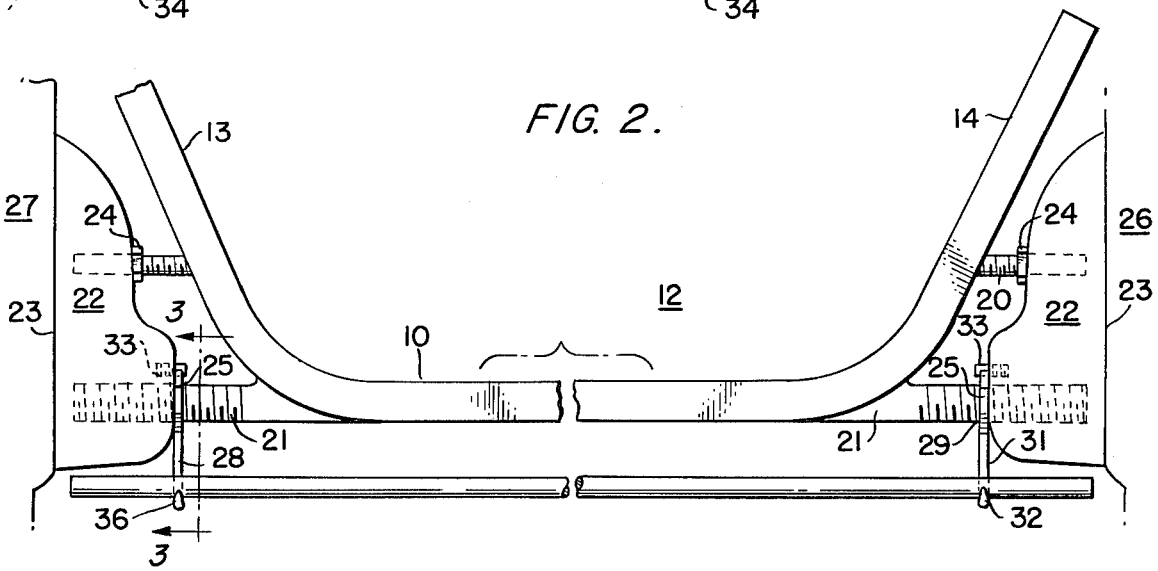
FIG. 2 is a top plan view with parts broken away to illustrate the invention.
Figure 4:
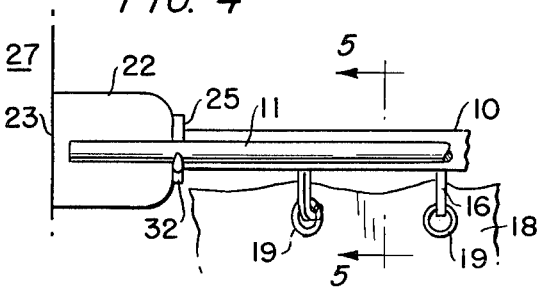
FIG. 4 is a front elevation with parts broken away.

As seen more particularly in FIG. 2 of the drawings, a decorative curtain hanger rod 11 extends in spaced parallel relationship with the curtain hanger rod 10 and is secured thereby by means of brackets 28, 29 which are each provided with the internally threaded screw member 25 and an arm 31 formed integral with the screw member 25 and which terminates in a hook member 32 which is adapted to support the decorative curtain hanger rod 11.

Screw member 25 is threaded over the externally threaded bolt 21 and as the screw member is threaded on to the aforesaid bolt, the same will cause the further tightening of the block 22 against the side walls 26, 27 of the stall 12. When the block has been forced against the said walls 26, 27, a set screw 33 is applied against the screw members 25, thereby preventing loosening of the screw on the bolts 20, 21.

A decorative curtain 34 constructed of any suitable material is provided with a looped portion at the upper end thereof and the supporting rod is threaded through the looped portion in order to suspend the curtain from the rod 11. The curtain 32 may comprise two half sections which may be separated when the shower stall is in use but which may be brought together in order to cover the shower curtain to thus enhance the appearance of the shower stall.

From the above description, it will be seen that I have devised a unique manner of suspending both a shower curtain and a decorative curtain overlying the shower curtain to thus present a pleasing appearance to the shower stall.

I claim:

1. A dual shower curtain support assembly comprising:

a pair of aligned rod support blocks adapted for support against opposed walls of a shower stall;

a pair of transversely spaced threaded rods extending from, and having sliding fits with, apertures in each opposed block face;

the opposed ends of said rods connecting with and supporting a curtain support rod;

means combined with said curtain support rod and threaded rods by which to hang a functional shower stall curtain and a decorative curtain;

adjusting nut means on each of said threaded rods whereby to bear against the opposed faces of the support blocks for pressuring the blocks against said opposed shower stall walls for firmly positioning said support assembly; wherein forwardly ones of said adjusting nuts each comprises a forwardly extending arm structure; means at free ends of said arms for supporting a second curtain rod; and said second rod comprising said means to hang the decorative curtain.

2. The support assembly of claim 1 wherein said means to hang a shower stall functional curtain comprises a slot means extending at least substantially through the axial extent of said curtain support rod and means slidable along the axial extent of said slot from which the functional curtain depends.

3. The support assembly of claim 2 wherein said slot is disposed in the underside of said curtain support rod.

4. The support assembly of claims 1, 2 or 3 wherein lock means, mounted on said blocks, are provided to secure said forwardly extending adjusting nut and arm structures.

5. The support assembly of any of claims 1, 2 or 3 wherein said curtain support rod is inwardly directed at its end whereby the functional shower curtain more securely contains the shower space.

* * * * *